US006152650A

United States Patent [19]

Heine

[11] Patent Number: 6,152,650

[45] Date of Patent: Nov. 28, 2000

[54] WASTEWATER AND EFFLUENT DISTRIBUTION SYSTEM

[75] Inventor: Michael V. Heine, Webster Groves, Mo.

[73] Assignee: Zoeller Company, Louisville, Ky.

[21] Appl. No.: 09/161,332

[22] Filed: Sep. 25, 1998

[51] Int. Cl.[7] ..... E02B 11/00

[52] U.S. Cl. ..... 405/36; 210/170; 405/52

[58] Field of Search ..... 405/36, 37, 39, 405/40, 41, 80, 87, 52; 239/193; 137/561 A, 610, 98, 614, 592; 138/37–39; 251/118; 210/170, 162, 294, 257.1

[56] References Cited

U.S. PATENT DOCUMENTS

| | | | |
|---|---|---|---|
| 3,497,067 | 2/1970 | Tyson . | |
| 3,956,137 | 5/1976 | Dempsey . | |
| 4,199,274 | 4/1980 | Loth | 405/80 X |
| 4,298,470 | 11/1981 | Stallings . | |
| 4,303,350 | 12/1981 | Dix | 405/36 |
| 4,464,079 | 8/1984 | Chance | 405/37 |
| 4,605,501 | 8/1986 | Tyson | 210/519 |
| 4,824,614 | 4/1989 | Jones | 138/37 X |
| 4,838,731 | 6/1989 | Gavin . | |
| 4,943,184 | 7/1990 | Humpherys et al. | 405/39 |
| 5,098,568 | 3/1992 | Tyson . | |
| 5,099,879 | 3/1992 | Baird | 137/561 A |
| 5,107,892 | 4/1992 | Plachy . | |
| 5,154,353 | 10/1992 | Plachy . | |
| 5,241,867 | 9/1993 | Cohen et al. | 137/561 A |
| 5,322,387 | 6/1994 | Heine et al. . | |
| 5,516,232 | 5/1996 | Filipski | 405/36 |
| 5,680,989 | 10/1997 | Plachy et al. . | |
| 5,735,304 | 4/1998 | Chumley | 137/561 A |

*Primary Examiner*—Dennis L. Taylor
*Attorney, Agent, or Firm*—Scott R. Cox

[57] ABSTRACT

A liquid distribution system for distributing effluent from a source of waste water. This liquid distribution system is contained within a distribution box and includes liquid inlet piping and a series of liquid flow splitting elements arranged in parallel, perpendicular to the horizontal flow of effluent through the distribution box. In addition, an adjustment system is incorporated into the liquid distribution system for maintaining the level of the liquid distribution system in the ground.

13 Claims, 5 Drawing Sheets

WASTEWATER AND EFFLUENT DISTRIBUTION SYSTEM

TECHNICAL FIELD

This invention relates to an improved distribution system for liquids, wastewater and effluent. In particular, this invention relates to a liquid distribution system for dividing the flow of wastewater or effluent into reasonably equal quantities for distribution to separate discharge pipes, for example in an absorption field, sandfilter or mound.

BACKGROUND ART

Wastewater and sewage disposal systems are designed to disperse wastewater and/or effluent discharged from a wastewater storage system or septic tank into an absorption field. For example, the effluent discharged from a septic tank is conventionally directed first into a standard effluent distribution box. The distribution box is intended to divide the flow of effluent into separate, reasonably equal quantities of effluent which then pass through separate discharge pipes for distribution in the absorption field. This division of effluent prevents overloading in a single discharge pipe. Unequal discharge of effluent in a single discharge pipe can result in disproportionate effluent loading in one of the discharge pipes which can saturate the soil in one location while other locations receive only minimal effluent.

Conventionally, distribution boxes have one singular sump, relying exclusively on the inherent characteristics of liquids to seek their own level and divide themselves into separate flows by means of a number of discharge pipes connected to the singular sump. Each discharge pipe directs an allocated portion of the effluent into different locations in the absorption field. Each of the discharge pipes in the distribution box must be set at exactly the same depth to achieve distribution of equal quantities of effluent into each of the discharge pipes. If the discharge pipes are set at different elevations, effluent entering the distribution box tends to flow out of the discharge pipe which is located at the lowest elevation in the distribution box, even if the difference in elevation among the discharge pipes is minimal. Even recognizing the need to maintain the discharge pipes located within the distribution box at the same depth, it is often difficult to install the discharge pipes perfectly level within the ground. In addition, even if the discharge pipes are properly installed, it is difficult to maintain them in a perfectly level position because of settling of the ground and other naturally occurring events.

A number of discharge systems have been proposed to solve this problem of equalizing the flow of effluent out of a distribution box. For example, U.S. Pat. No. 4,298,470 discloses a sewage septic system which includes a septic tank (14) and a distribution box (20), wherein the piping (26) for the effluent in the distribution box (20) includes a liquid leveling cap (34) containing an effluent opening (40). The level of these openings (40) in the caps (34) can be adjusted to accommodate different effluent levels of the piping within the distribution box (20).

U.S. Pat. No. 3,497,067 discloses a distribution box (10) used in conjunction with a septic tank absorption field system to control the relative flow of septic tank effluent among separate discharge pipes (18). In this system, a flow divider, or partition (19), is provided in a lower portion of the distribution box (10). This flow divider (19) has an upwardly projecting knife edge (20) designed to divide the flow of effluent entering the distribution box (10) into separate, generally equal quantities, regardless of the level of the discharge pipes (18) in the distribution box (10). An improvement on this system is disclosed in U.S. Pat. No. 4,605,501. In this system, the flow divider (26) is designed with a particular shape which fits within the discharge pipes (14).

An additional improvement on this system is disclosed in U.S. Pat. No. 5,098,568. In this system the distribution joint (18) contains two or more distribution lines (16a and 16b) leading to separate adsorption fields. A flow divider (24) extends across an outlet line (22) in the throat area where the distribution lines (16a and 16b) join. A cylindrical control sleeve or flow director (26) is rotatably mounted inside the effluent line (14) and is used to direct the effluent into the respective distribution line (16a and 16b).

U.S. Pat. No. 4,838,731 discloses a pivotable tray (26), which is installed within a distribution box (12). The effluent from the septic tank flows into this pivotable tray (26) where it collects until its weight causes the tray (26) to pivot and discharge effluent among various discharge outlet pipes (52).

U.S. Pat. No. 5,322,387 discloses a complicated distribution system for equalizing the flow of fluid through a sewage disposal system.

U.S. Pat. Nos. 5,107,892, 5,154,353 and 5,680,989 disclose a cap that is placed on the end of piping present in a distribution box. Each of these caps contains a weir, which is designed to equalize the flow of effluent out of the discharge pipes of the distribution box.

U.S. Pat. No. 3,956,137 discloses a sewage septic system which contains a plurality of discharge lines (23, 24). The flow of effluent in each of these discharge lines may be controlled by a separate gate valve (26, 27), each of which permits full flow, partial flow or no flow through its respective discharge line.

The present invention is designed to distribute effluent equally among several discharge pipes and represents a significant improvement over the previous products that have relied on a singular sump and a static rise of liquids along with the inherent characteristic of those liquids to seek their own level.

Accordingly, it is an object of the invention to provide an improved product for distributing effluent from a septic system in generally equal quantities into multiple discharge pipes.

It is a still further object of the invention to provide a system which equalizes the flow of effluent out of a distribution box.

It is a still further object of the invention to disclose a system for splitting the flow of effluent entering a discharge box into a number of different independent sumps and then into a number of corresponding discharge pipes by use of a series of parallel, liquid flow splitting elements.

It is a still further object of the invention to provide an adjustment system for adjusting the relative position of the liquid distribution system within an effluent discharge system.

These and other objects of the invention will be apparent from the effluent distribution system disclosed by the present invention.

SUMMARY OF INVENTION

The present invention discloses a liquid distribution system, particularly an effluent distribution system enclosed in a distribution box. Effluent from a septic tank flows into the distribution box through an inlet pipe for distribution by a series of outlet pipes into an absorption field. The liquid distribution system includes a liquid flow splitting system, containing a plurality of separate liquid outlet flow splitting elements. A series of separate liquid outlet flow channels are formed by these liquid outlet flow splitting elements, each of which encourages the effluent into a separate independent sump and then into a corresponding outlet pipe for final distribution in an absorption field.

In a preferred embodiment, the liquid flow splitting system includes slots for outlet flow stop elements in the outlet flow channels to reduce the number of available liquid outlet flow channels which can be used.

In a further preferred embodiment, the liquid distribution system includes a level system to monitor the relative position of the liquid distribution system in the ground and an adjusting system to adjust the relative position of the liquid distribution system in the ground.

In a further preferred embodiment, an inspection port is provided in the liquid distribution system so that the relative position of the liquid distribution system can be monitored from above ground.

DETAILED DESCRIPTION OF THE PREFERRED EMBODIMENT

Figure 1:
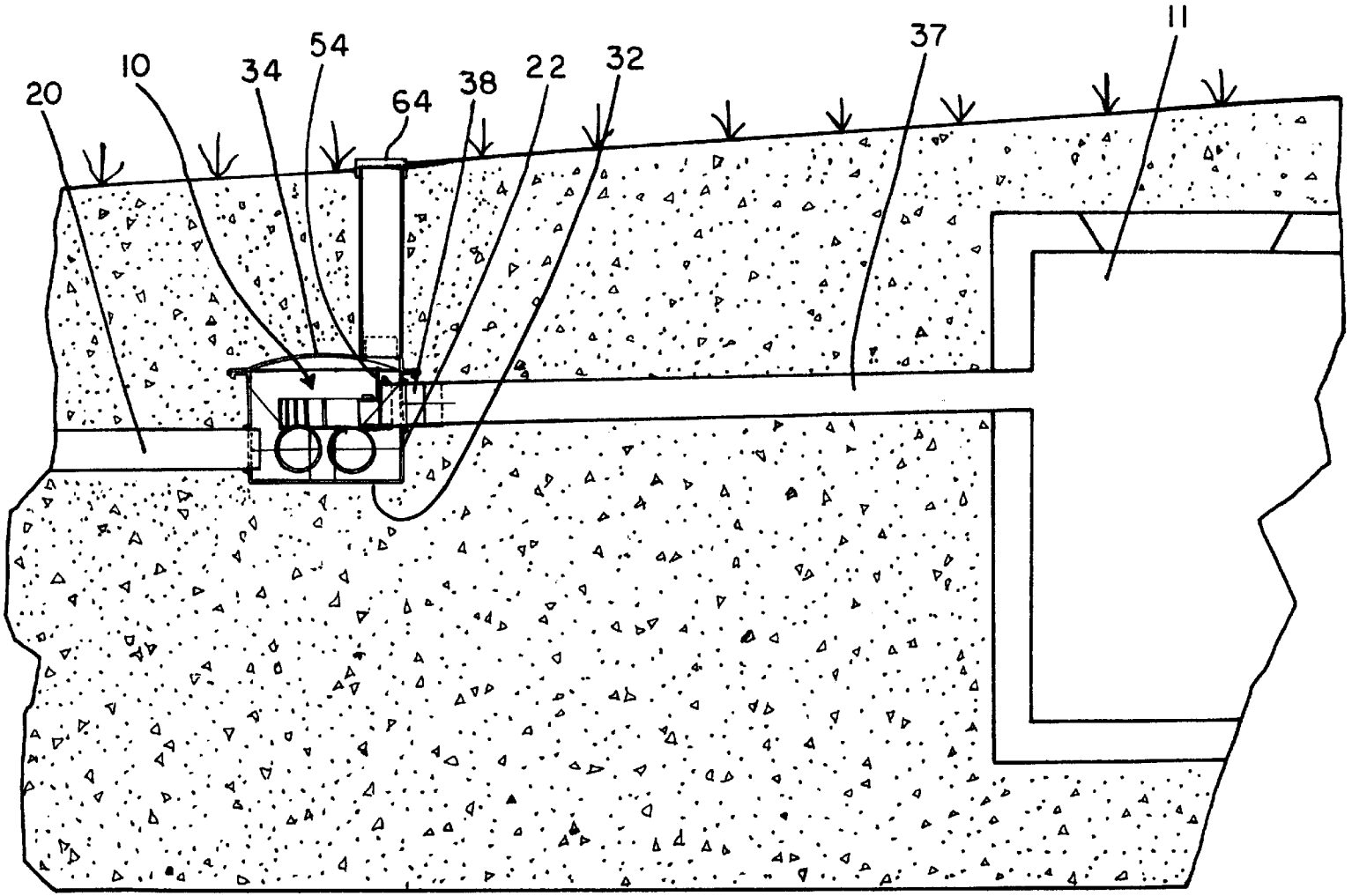
FIG. 1 is a side view of the liquid distribution system contained in a distribution box connected to a septic tank system in the ground.

The present invention is a liquid distribution system (10) designed to receive small or large quantities of effluent and divide that effluent into a series of relatively equal quantities for distribution among separate outlet pipes (20) in an absorption field. The liquid distribution system (10) is designed for utilization with a waste water distribution system, for example, a septic tank (11) as shown in FIG. 1.

Figure 2:
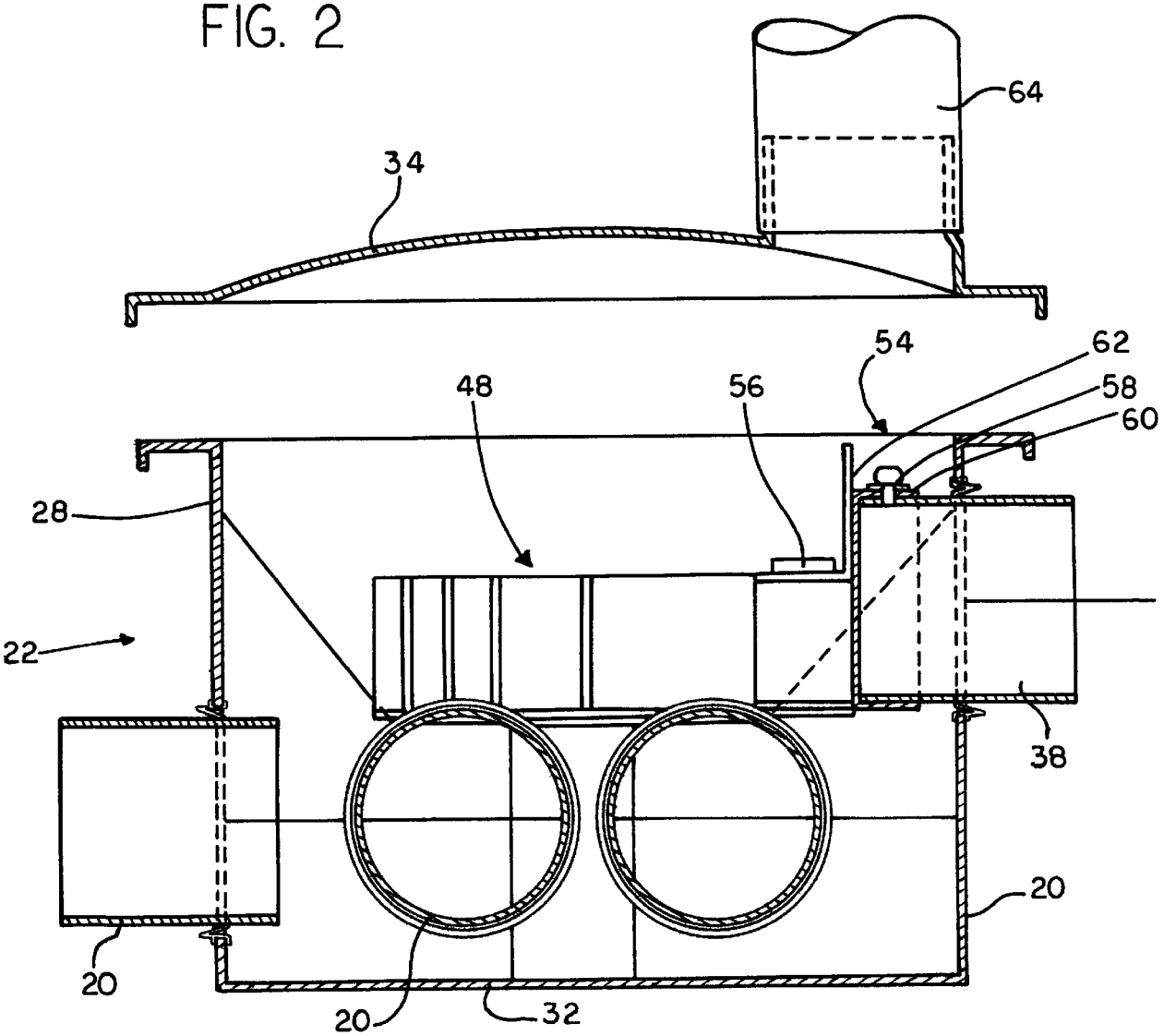
FIG. 2 is a side view of the liquid distribution system contained in the distribution box.
Figure 3:
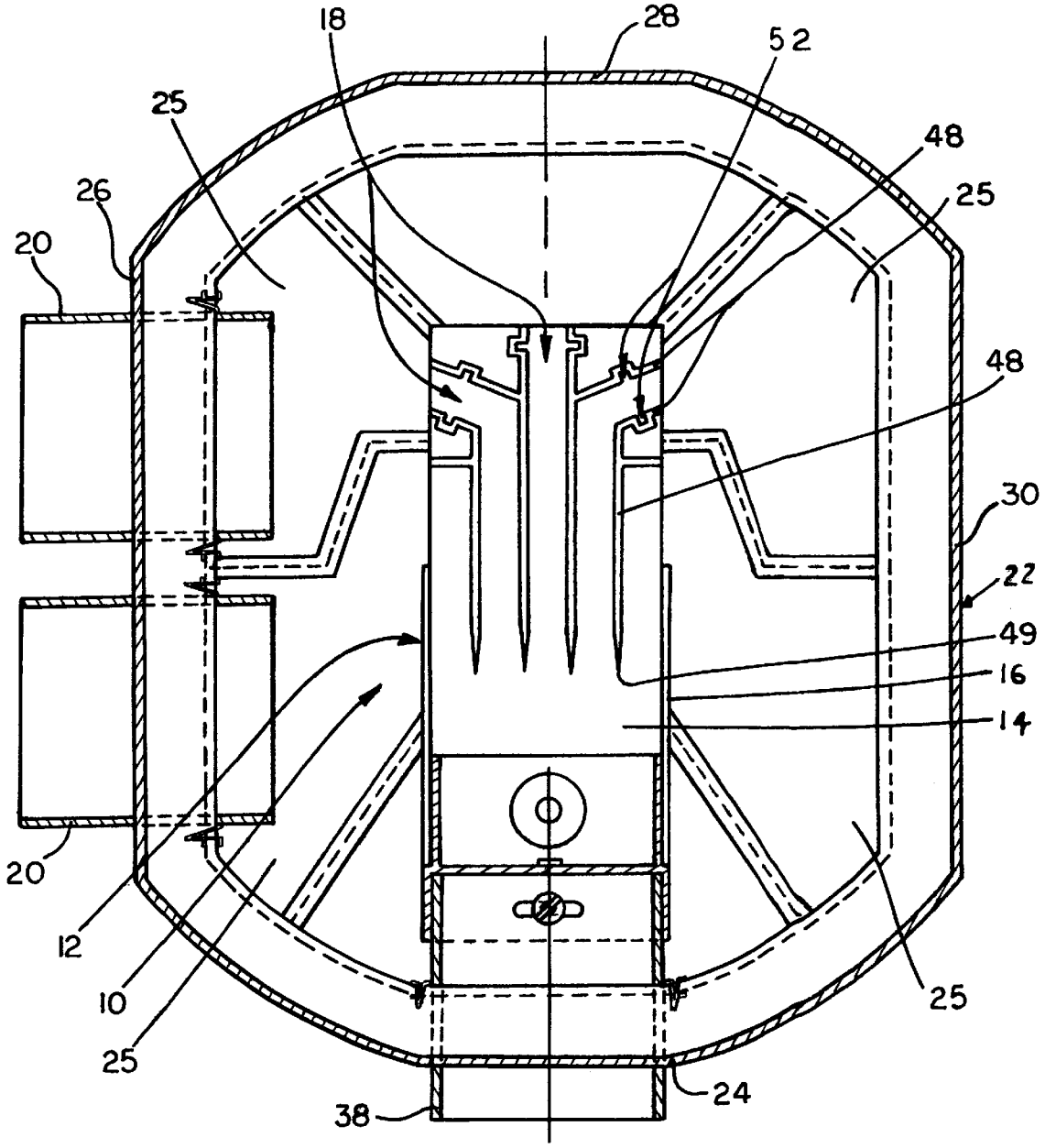
FIG. 3 is a top view of the liquid distribution system contained in the distribution box.

The liquid distribution system (10) including a generally box-like liquid distribution container (12) with a generally flat, bottom surface (14) and side walls (16). It is preferably enclosed within a distribution box (22) having four sides (24, 26, 28, 30), a base (32), a removable top (34), and a number of individual sumps (25) into which the effluent drops from the liquid distribution container (12) as shown in FIGS. 2 and 3. This distribution box (22) is located downstream from the septic tank (11) and is buried underground. Effluent enters the distribution box (22) through an inlet pipe (38), as shown in FIG. 1.

Figure 4:
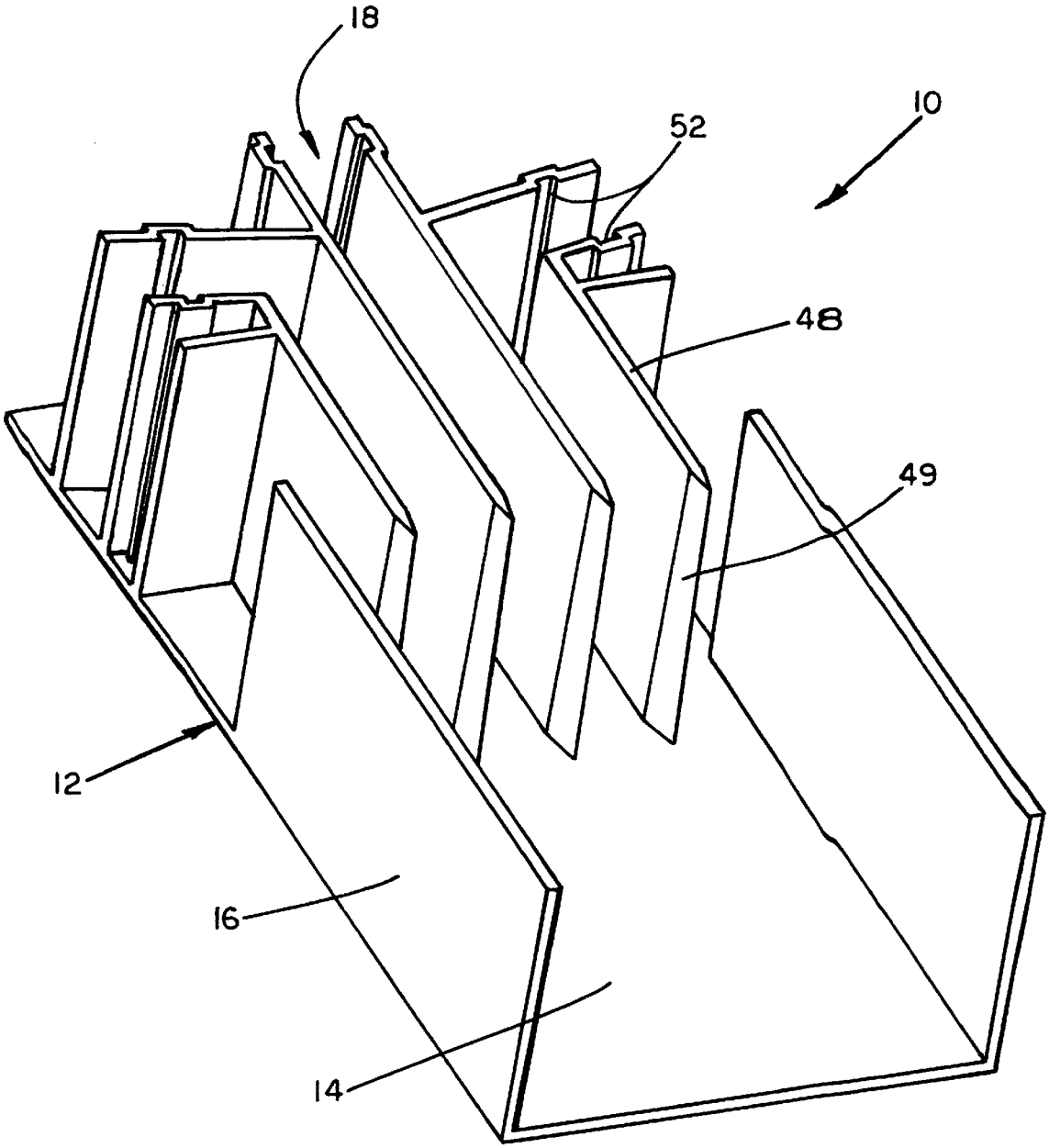
FIG. 4 is a top perspective view of the liquid distribution system.
Figure 5:
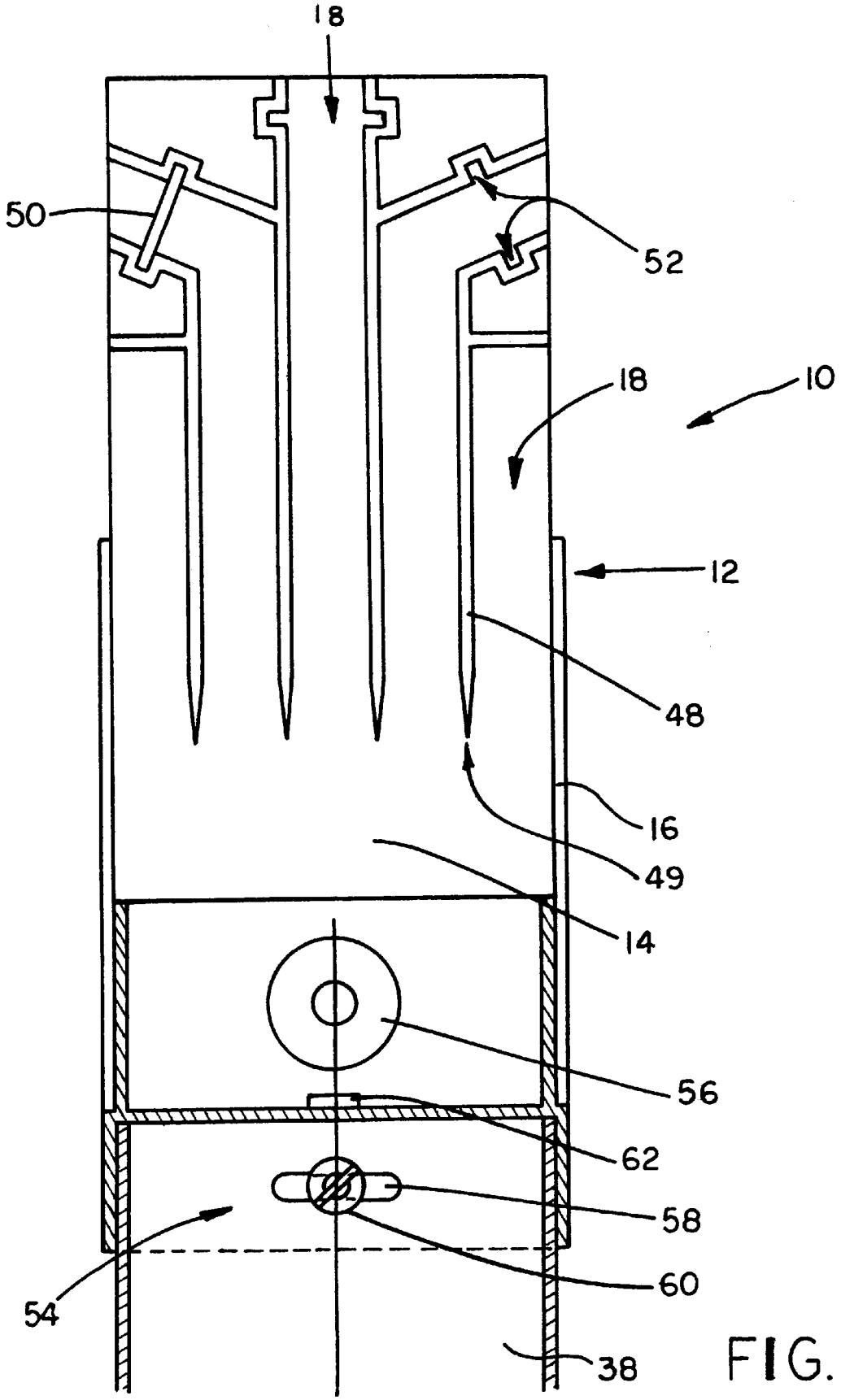
FIG. 5 is a top view of the liquid distribution system.

The liquid distribution system (10) includes a series of generally parallel liquid flow splitting elements (48) which extend from the bottom surface (14) of the liquid distribution container (12) to or near the top of the inlet pipe (38) and form individual liquid outlet flow channels (18) as shown in FIGS. 2–5. These liquid flow splitting elements (48) are arranged in a generally parallel pattern, perpendicular to the horizontal flow of effluent through the distribution box (22). These liquid outlet flow channels (18) are preferably walls that extend through the distribution box (22) from or near the end of the inlet pipe (38) to the separate outlet pipes (20). Preferably, the front edge (49) of each liquid flow splitting element (48) has a sharp edge as shown in FIGS. 3, 4 and 5 for a better division of the effluent.

Any number of such liquid flow splitting elements (48) may be included in the liquid distribution system (10). As shown in FIGS. 3 through 5, four liquid flow splitting elements (48) are provided which form five separate liquid outlet flow channels (18) and assist in the division of the effluent to be discharged from the liquid distribution system (10).

These liquid flow splitting elements (48) are preferably made of a high quality plastic material formed by any conventional plastic forming process.

To reduce the number of liquid outlet flow channels (18) which discharge effluent from the liquid distribution system (10), liquid outlet stops (50) may be incorporated into liquid outlet stop slots (52) in the liquid flow splitting elements (48), as shown in FIG. 5. Each liquid outlet stop (50) prevents the flow of effluent out of a single liquid outlet flow channel (18). When a liquid outlet stop (50) is installed within the liquid outlet stop slots (52), the effluent backs up in that particular liquid outlet flow channel (18) and is discharged through adjacent liquid outlet channels (18) which do not contain liquid outlet stops (50).

Even with the improvements provided by the liquid distribution system (10), in order to assure equalization of the flow of the effluent among the respective liquid outlet flow channels (18), it is important that the liquid distribution system (10) be maintained in a level position. Effluent entering the distribution box (22) has a tendency to flow out of the lowest liquid outlet flow channel (18), even with the use of the liquid flow splitting elements (48), and even if the distribution box (22) is only 20 slightly out of level. Thus, in a preferred embodiment, an adjustment system (54) as shown in FIGS. 2, 3 and 5 is incorporated into the liquid distribution system (10) to level the liquid distribution system (10) that is connected to, but independent from, the distribution box (22). In a preferred embodiment, this adjustment system (54) includes a bubble level (56), which shows the relative position of the liquid distribution system (10). The adjustment system (54) also preferably includes a thumb screw (58) with washer (60) and an adjusting lever (62). With a wrench (not shown), preferably a thumb screw wrench on a rod (not shown), the thumb screw (58) is loosened and the lever (62) is moved by the wrench on the rod to level the liquid distribution system (10). After the bubble level (56) is centered, the thumb screw (58) is tightened to secure the liquid distribution system (10) in its level position.

To monitor the flow of the effluent through the liquid distribution system (10), an inspection port (64) is preferably incorporated into the removable top (34) of the distribution box (22), as shown in FIGS. 1 and 2. This inspection port (64) permits viewing of the adjustment system (54) and provides an opening for access to the liquid distribution system (10) by a person on the surface. This person can view the bubble level (56) and make adjustments to the relative position of the liquid distribution system (10) by manipulating the adjusting lever (62) of the adjustment system (54).

In operation, effluent from the septic tank (11) passes down its discharge piping (37) into the inlet pipe (38) for passage through the distribution box (22). The effluent then encounters the edges (49) of the liquid flow splitting elements (48). The liquid flow splitting elements (48) form the series of liquid outlet flow channels (18). The effluent passing through to the distribution box (22) is channeled in a parallel pattern to the horizontal flow of effluent into these separate liquid outlet flow channels (18). The effluent is thus divided into generally equal, separate streams of effluent which pass through the liquid outlet flow channels (18) and fall down into separate sumps (25) which feed into the outlet pipes (20) for distribution among the various lines of the absorption fields.

In a preferred embodiment, an adjusting system (54) is incorporated into the liquid distribution system (10) which includes a bubble level (56) to indicate the relative position of the liquid distribution system (10) and an adjusting lever (62) to adjust the relative position of the liquid distribution system (10).

By this liquid distribution system (10), the amount of effluent can be equalized among the various outlet pipes (20) so that disproportionate loading of any individual outlet pipe (20) is discouraged.

It will be apparent from the foregoing that while particular forms of the invention have been illustrated and described, various modifications can be made without departing from the spirit and scope of the invention.

What is claimed is:

1. A liquid distribution system for distributing a flow of effluent in the ground comprising a liquid inlet system, a distribution box in communication with the liquid inlet system, comprising a bottom surface, side walls and a top, a plurality of liquid flow splitting elements secured in the distribution box comprising a series of walls secured to the bottom surface of the distribution box, wherein the walls are arranged in parallel, perpendicular to the horizontal flow of effluent through the distribution box, wherein the walls form a plurality of channels in the distribution box, and a liquid outlet system secured to the distribution box, wherein the walls encourage the flow of the effluent to the liquid outlet system.

2. The liquid distribution system of claim 1 further comprising a removable stop attachable to walls of the liquid flow splitting elements to stop the flow of effluent through one of the channels.

3. The liquid distribution system of claim 1 further comprising an adjustment system secured to the distribution box for monitoring the relative position of the distribution box in the ground.

4. The liquid distribution system of claim 3 further comprising a system secured to the distribution box for adjusting the relative position of the distribution box in the ground.

5. The liquid distribution system of claim 1 further comprising a viewing system to view the relative position of the liquid distribution system in the ground from above ground.

6. The liquid distribution system of claim 5 wherein the viewing system comprises an inspection port in a top of the distribution box.

7. An effluent distribution system for distributing a flow of effluent in the ground comprising a septic tank, a piping system in communication with the septic tank, a liquid inlet system in communication with the piping system, a distribution box in communication with the liquid inlet system comprising a bottom surface, side walls and a top, a plurality of effluent flow splitting elements secured in the distribution box comprising a series of walls secured to the bottom surface of the distribution box, arranged in parallel, which elements are perpendicular to the horizontal flow of effluent through the distribution box, wherein the walls form a plurality of channels in the distribution box, and a liquid outlet system secured to the distribution box, wherein the walls encourage the flow of the effluent to the liquid outlet system.

8. The liquid distribution system of claim 7 wherein the effluent flow splitting elements form a plurality of liquid outlet flow channels.

9. The liquid distribution system of claim 7, further comprising a removable stop attachable to walls of the liquid flow splitting elements to stop the flow of effluent through the channels.

10. The liquid distribution system of claim 7 further comprising an adjustment system secured to the distribution box for adjusting the relative position of the distribution box in the ground.

11. The liquid distribution system of claim 10 further comprising a system secured to the distribution box for monitoring the relative position of the distribution box in the ground.

12. The liquid distribution system of claim 7 further comprising a viewing system secured to the distribution box to view the relative position of the liquid distribution system in the ground from above ground.

13. The liquid distribution system of claim 12 wherein the viewing system comprises an inspection port in a top of the distribution box.

* * * * *